US010993869B2

(12) United States Patent
Yang et al.

(10) Patent No.: US 10,993,869 B2
(45) Date of Patent: May 4, 2021

(54) FINGER MOTION AID AND REHABILITATION HAND HAVING SAME

(71) Applicants: BEIJING HENGTONG XINJIA TECHNOLOGY DEVELOPMENT CO, LTD., Beijing (CN); ZHONGSHAN CHANGYAO MEDICAL EQUIPMENT CO, LTD., Zhongshan (CN)

(72) Inventors: Keqiang Yang, Beijing (CN); Zhenwei Mao, Beijing (CN); Keijiron Yamamoto, Kanagawa (JP)

(73) Assignees: BEIJING HENGTONG XINJIA TECHNOLOGY DEVELOPMENT CO, LTD., Beijing (CN); ZHONGSHAN CHANGYAO MEDICAL EQUIPMENT CO, LTD., Zhongshan (CN)

( * ) Notice: Subject to any disclaimer, the term of this patent is extended or adjusted under 35 U.S.C. 154(b) by 0 days.

(21) Appl. No.: 16/626,536

(22) PCT Filed: Jul. 3, 2018

(86) PCT No.: PCT/CN2018/094198
§ 371 (c)(1),
(2) Date: Dec. 25, 2019

(87) PCT Pub. No.: WO2019/007313
PCT Pub. Date: Jan. 10, 2019

(65) Prior Publication Data

US 2020/0281797 A1 Sep. 10, 2020

(30) Foreign Application Priority Data

Jul. 7, 2017 (CN) ..... 201710552260.3

(51) Int. Cl.
*A61H 1/00* (2006.01)
*A61H 1/02* (2006.01)

(52) U.S. Cl.
CPC ... *A61H 1/0288* (2013.01); *A61H 2201/0157* (2013.01); *A61H 2201/1207* (2013.01);
(Continued)

(58) Field of Classification Search
CPC ..... B25J 9/104; B25J 9/1694; B25J 9/0006; A61H 3/00; A61H 1/0288;
(Continued)

(56) References Cited

U.S. PATENT DOCUMENTS 3,581,740 A * 6/1971 Sherbourne ..... A61H 1/0288 602/13
3,756,222 A * 9/1973 Ketchum ..... A61H 1/0288 601/40
(Continued)

FOREIGN PATENT DOCUMENTS

CA 2794193 A1 * 9/2011 ..... A63B 21/4021
CN 101433491 A 5/2009
(Continued)

*Primary Examiner* — Tu A Vo
(74) *Attorney, Agent, or Firm* — Bayramoglu Law Offices LLC

(57) ABSTRACT

A rehabilitation hand including a finger motion aid. The finger motion aid includes a rubber member, wherein a finger sleeve is provided at a front end of the rubber member. The finger sleeve has an open end where a finger can extend through the open end. The rubber member can be worn on the finger by the finger sleeve. A space, which is formed by a first bridge, a last bridge, a plurality of intermediate bridges and a plurality of grooves, is provided on a front face of the rubber member and a chip is placed in the space. The rehabilitation hand includes at least one of a thumb motion aid, an index finger motion aid, a middle finger motion aid,
(Continued)

a ring finger motion aid, a little finger motion aid, a controller and a protective gear.

4 Claims, 7 Drawing Sheets

(52) U.S. Cl.
CPC ..... *A61H 2201/165* (2013.01); *A61H 2201/1635* (2013.01); *A61H 2201/1638* (2013.01); *A61H 2205/067* (2013.01)

(58) Field of Classification Search
CPC .... A61H 2201/1238; A61H 2201/1409; A61H 2201/1638; A61H 2201/165; A61H 1/00; A61H 1/02; A61H 1/0237; A61H 1/024; A61H 1/0244; A61H 1/0255; A61H 1/0285; A61H 1/0262; A61H 1/0274; A61H 2201/0103; A61H 2201/5056; A61H 9/00; A61H 9/0078
See application file for complete search history.

(56) References Cited

U.S. PATENT DOCUMENTS

| | | | | | |
|---|---|---|---|---|---|
| 3,937,215 | A * | 2/1976 | Barthlome | A61H 1/0288 | 601/40 |
| 4,671,258 | A * | 6/1987 | Barthlome | A61H 1/0288 | 128/DIG. 20 |
| 5,103,807 | A * | 4/1992 | Makaran | A61H 1/0288 | 601/40 |
| 5,178,137 | A * | 1/1993 | Goor | A61F 5/0111 | 601/40 |
| 5,261,393 | A * | 11/1993 | Weinzweig | A61H 1/0288 | 2/21 |
| 5,697,892 | A * | 12/1997 | Torgerson | A61H 1/0288 | 601/40 |
| 6,010,468 | A * | 1/2000 | Grove | A61H 1/0266 | 601/23 |
| 10,646,356 | B2 * | 5/2020 | Deshpande | A61F 2/586 | |
| 2003/0162634 | A1 | 8/2003 | Farrell et al. | | |
| 2011/0118635 | A1 * | 5/2011 | Yamamoto | A61H 1/0237 | 601/5 |
| 2012/0059290 | A1 * | 3/2012 | Yip | A61H 1/0288 | 601/40 |
| 2012/0059291 | A1 * | 3/2012 | Nguyen | A61H 1/0288 | 601/40 |
| 2013/0226350 | A1 * | 8/2013 | Bergelin | A61H 1/0288 | 700/275 |
| 2015/0374575 | A1 * | 12/2015 | Kamper | A61H 1/0288 | 601/40 |
| 2016/0252110 | A1 * | 9/2016 | Galloway | A61F 2/68 | 60/327 |
| 2016/0327435 | A1 * | 11/2016 | Tseng | G01K 7/22 | |
| 2018/0296419 | A1 * | 10/2018 | Tong | A61H 1/02 | |
| 2018/0297214 | A1 * | 10/2018 | Lessing | G01T 7/00 | |
| 2018/0303698 | A1 * | 10/2018 | Wijesundara | F15B 15/10 | |
| 2018/0335842 | A1 * | 11/2018 | Rubin | G06F 3/014 | |
| 2019/0056248 | A1 * | 2/2019 | Shepherd | B25J 9/142 | |

FOREIGN PATENT DOCUMENTS

| | | | | |
|---|---|---|---|---|
| CN | 101511310 | A | 8/2009 | |
| CN | 101940522 | A | 1/2011 | |
| CN | 102711933 | A | 10/2012 | |
| CN | 104586608 | A | 5/2015 | |
| CN | 204910720 | U | 12/2015 | |
| CN | 205181730 | U | 4/2016 | |
| CN | 205698416 | U | 11/2016 | |
| CN | 205758934 | U | 12/2016 | |
| CN | 106625733 | A | 5/2017 | |
| CN | 107157713 | A | 9/2017 | |
| WO | 2006063347 | A2 | 6/2006 | |
| WO | WO-2015095459 | A1 * | 6/2015 | B25J 9/0006 |
| WO | 2015134336 | A2 | 9/2015 | |
| WO | WO-2016088071 | A1 * | 6/2016 | A63B 23/16 |

* cited by examiner

FINGER MOTION AID AND REHABILITATION HAND HAVING SAME

CROSS REFERENCE TO THE RELATED APPLICATIONS

This application is the national phase entry of the International Application No. PCT/CN2018/094198, filed on Jul. 3, 2018, which is based upon and claims priority to the Chinese Patent Application No. 201710552260.3, filed on Jul. 7, 2017, wherein the entire contents of which are incorporated herein by reference.

TECHNICAL FIELD

The present invention relates to the technical field of joint motion assistance, and in particular to a finger assisted motion member and a rehabilitation hand device having same.

BACKGROUND

It has been clinically proven that continuous passive exercises can compensate for the lack of active exercises of a patient, increase the physical activity of the patient, and also reduce the corresponding complications after a limb surgery or during early rehabilitation and spontaneous recovery of a cranial nerve injury of the patient. In addition, there is currently a situation for a patient in which a finger is paralyzed and contracted due to a central nervous system injury such as cerebral infarction. In this situation, if a professional rehabilitation trainer or a surgeon et al. wears a rehabilitation hand device to stretch and clench fingers and then a signal of finger movement is transmitted from a chip in the rehabilitation hand device, via a transmission device, to a chip of a rehabilitation hand worn by the patient, the patient is controlled to synchronize with the person (the professional rehabilitation trainer, the surgeon or the patient himself, et al.) who actively sends out a motion signal to perform the movement of the fingers, so that the recovery process of the patient's fingers can be accelerated.

In view of the above needs, the inventor of the present invention has finally obtained the present invention after a long period of research and practices.

SUMMARY

In order to solve the above technical defects, firstly, the technical solution used by the present invention is to provide a finger motion aid, which comprises: a rubber member.

A finger sleeve is provided at a front end of the rubber member, the finger sleeve has an open end, a finger can extend through the open end, and the rubber member can be worn on the finger by means of the finger sleeve. A space, which is formed by a first bridge, a last bridge, a plurality of intermediate bridges and a plurality of grooves, is provided on a front face of the rubber member, and a chip is placed in the space. The width of the elongated space is greater than the width of the chip.

Preferably, the length of each of the first bridge and the last bridge is greater than the length of each of the intermediate bridges to prevent the chip from exiting from the first bridge and the last bridge.

Preferably, the finger sleeve has a segment of a flat surface at a position in which the finger sleeve is in contact with a finger pad for supporting the finger.

Preferably, a back side of the rubber member has a curve radian that matches the finger.

Preferably, the finger motion aid further comprises a plastic cover that is disposed on and fixedly connected to the rubber member.

Preferably, the finger motion aid further comprises a hook-and-loop fastener that is disposed underneath and fixedly connected to the rubber member.

Secondly, there is also provided a rehabilitation hand having the finger motion aid as described above. The rehabilitation hand comprises at least one of a thumb motion aid, an index finger motion aid, a middle finger motion aid, a ring finger motion aid and a little finger motion aid, and further comprises a controller and a protective gear.

The controller is disposed on and fixedly connected to the protective gear.

The controller is electrically connected to chips on the thumb motion aid, the index finger motion aid, the middle finger motion aid, the ring finger motion aid and the little finger motion aid, respectively. An active assistance signal is received by the controller and synchronously transmitted to the chips on the five finger motion aids, so that the chips on the five finger motion aids are forced to synchronously perform an action of the same intensity as performed by a professional rehabilitation person.

Hook-and-loop fasteners on the thumb motion aid, the index finger motion aid, the middle finger motion aid, the ring finger motion aid and the little finger motion aid are respectively bonded to the protective gear.

The protective gear is fixed on a wrist and a palm.

Preferably, the protective gear is embedded with a hard sheet at one end to facilitate wearing the protective gear on the wrist and the palm.

Compared with the prior art, the beneficial effects of the present invention are as follows: a finger wearing a finger motion aid is forced to perform synchronous motions as the finger motion aid provided with a chip is performing bending and stretching motions upon receipt of a signal by the chip, thus helping a patient to perform rehabilitation training; and if a rehabilitation hand having a controller, the finger motion aids and a protective gear is worn, an active motion signal is received by the controller and transmitted to chips on the finger motion aids, such that the chips perform synchronous motions according to the received active motion signal, thereby forcing the finger wearing the finger motion aid to perform synchronous motions and thus perform synchronous rehabilitation training.

BRIEF DESCRIPTION OF THE DRAWINGS

To describe the technical solutions in various embodiments of the present invention more clearly, the accompanying drawings required for describing the embodiments will be briefly introduced below.

DETAILED DESCRIPTION OF THE EMBODIMENTS

The above and other technical features and advantages of the present invention are described in more detail below with reference to the accompanying drawings.

First Embodiment

Figure 1:
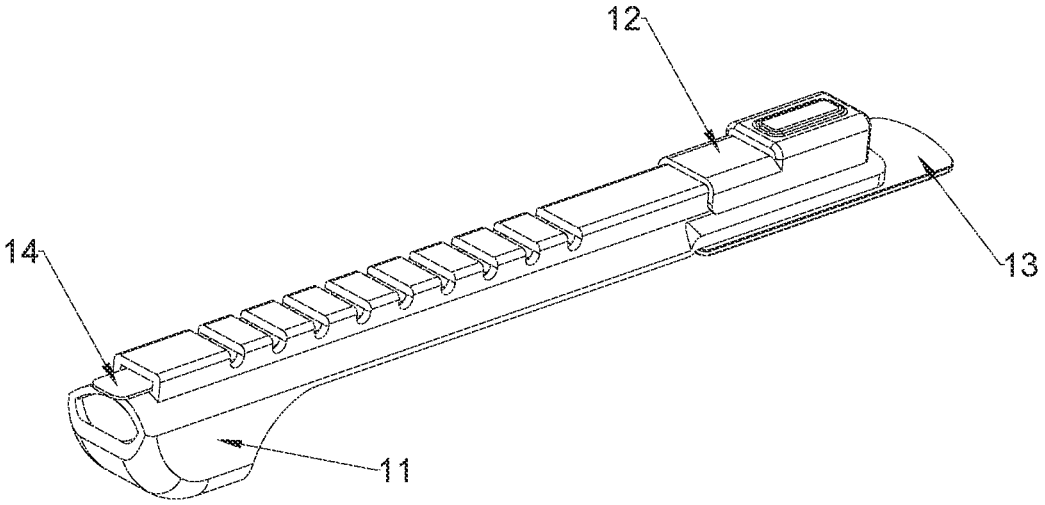
FIG. 1 shows a structural view showing the front side of a finger motion aid in a first embodiment.
Figure 2:
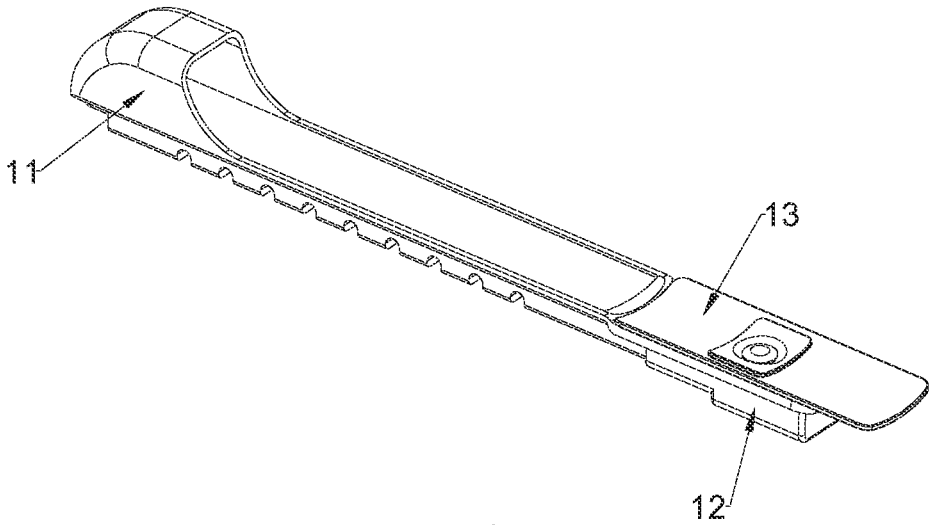
FIG. 2 shows a structural view showing the back side of the finger motion aid in the first embodiment.

A finger motion aid, as shown in FIGS. 1 and 2, comprises a rubber member 11, a plastic cover 12, a hook-and-loop fastener 13 and a chip 14.

The rubber member 11 is worn on a finger, and the chip 14 is placed in the rubber member 11. After a control signal is received by the chip 14, the rubber member 11 is controlled to bend and stretch, thereby driving a patient's finger to bend and stretch. The rubber member 11 is made of a plastic material, and because the initial state of the patient's fingers is bent, the tensile property of the rubber member 11 is required to be strong. When a retraction command is received by the chip 14 to force the rubber member 11 to retract, the patient's finger is passively stretched to do rehabilitation training, and in that case, the rubber member 11 is required to have a good retraction property.

Figure 3:
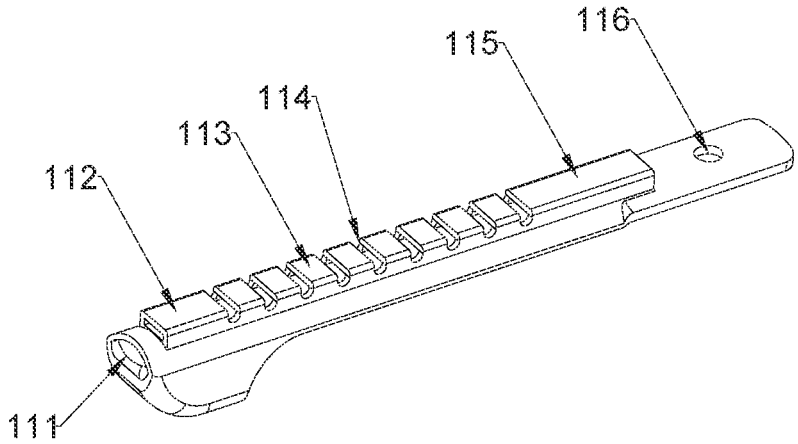
FIG. 3 shows a structural view showing the front side of a rubber member in the first embodiment.
Figure 4:
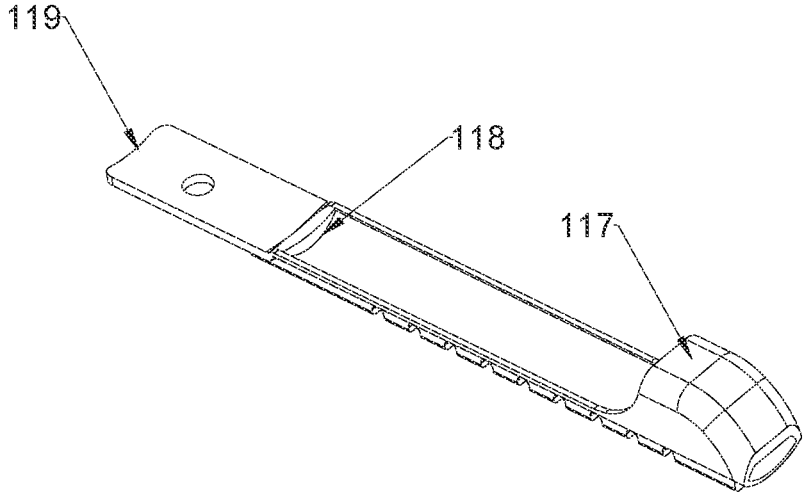
FIG. 4 shows a structural view showing the back side of the rubber member in the first embodiment.

The rubber member 11 is as shown in FIGS. 3 and 4, a finger sleeve is provided at a front end of the rubber member 11, and the rubber member 11 is worn on the patient's finger by extending same into the finger sleeve. The finger sleeve has a segment of a flat surface 117 at a position in which the finger sleeve is in contact with a finger pad for supporting the finger. The finger sleeve has an open end 111 and the patient's finger can extend from the open end 111 to facilitate enhancing the touch sense of the patient's finger. An elongated space, which is formed by a first bridge 112, a plurality of intermediate bridges 113, a plurality of grooves 114 and a last bridge 115, is provided on a front face of the rubber member 11, and the chip 14 is placed in the elongated space. The width of the elongated space is greater than the width of the chip. The rubber member 11 worn on the finger can be bent and deformed as the finger of the person is deformed and bent. The width of the elongated space being greater than the width of the chip allows reduced deformation of the chip in the elongated space. The bridge 112 and the bridge 115 are slightly longer in length, the length of the bridge 112 is in the range of approximately 12-17 mm, and the length of the bridge 115 is in the range of approximately 17-20 mm, thereby preventing the chip 14 from exiting from the bridge 112 and the bridge 115 during bending. There are at least three bridges 113 between the bridge 112 and the bridge 115 that have the width of about 6 mm. There is a groove 114 between two bridges 113 that has the width of 3 mm. The arrangement of the groove 114 is for the purpose of adding the flexibility of the rubber member 11 and thus allowing the rubber member 11 to be more closely fitted to the patient's finger during bending and stretching of the rubber member 11 so as to assist the patient's finger motion. The curve radian of a curved surface 118 on the back side of the rubber member 11 is greater than that of a curved surface 119, and the curved surface 118 is more closely fitted to the patient's finger when the rubber member 11 is bent and retracted. The curved surface 119 has a smaller curve radian and thus is convenient to fit with the hook-and-loop fastener 13.

Figure 5:
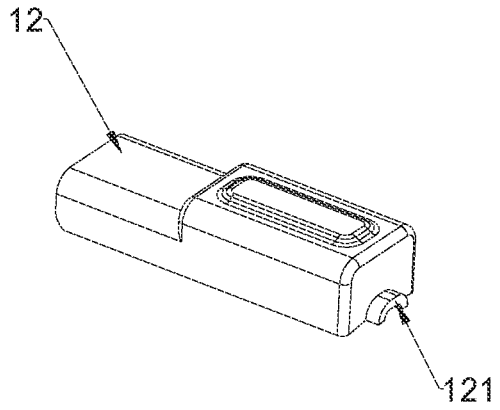
FIG. 5 shows a structural view showing the front side of a plastic cover in the first embodiment.
Figure 6:
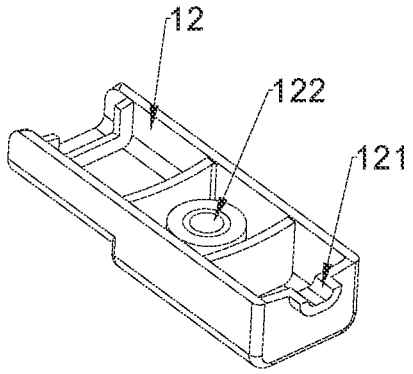
FIG. 6 shows a structural view showing the back side of the plastic cover in the first embodiment.
Figure 7:
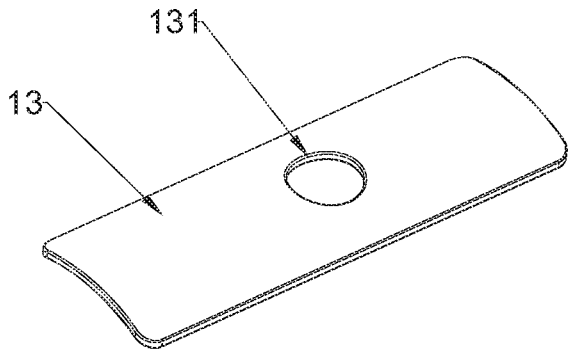
FIG. 7 shows a structural view of a hook-and-loop fastener in the first embodiment.
Figure 8:
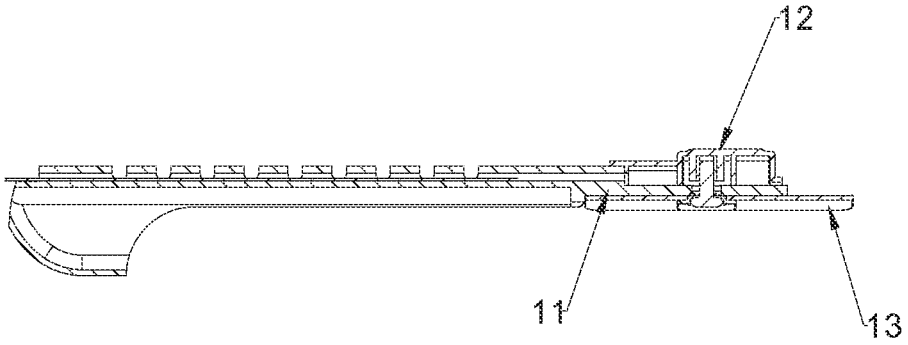
FIG. 8 shows a cross-section view of the finger motion aid in the first embodiment.

The plastic cover 12, as shown in FIGS. 5 and 6, is used for fixing an electric wire between the chip 14 and the controller to prevent, due to the chip 14 moving together with the movement of the electric wire, the rubber member 11 from deviating from the patient's finger and affecting the assistance motion effect. The electric wire connected to the chip 14 is connected to the controller through a hole 121. A hole 122, a hole 116 and a hole 131 (as shown in FIG. 7) are fixed together by a screw, as shown in FIG. 8.

The hook-and-loop fastener 13 has a smaller curve radian and thus is convenient to be bonded with a protective gear. One side of the hook-and-loop fastener is fixedly connected to the rubber member 11 and the plastic cover 12 by the screw at the hole 131, and the other side thereof is bonded to the protective gear by means of a bonding face.

The finger motion aid suitable for each of the fingers is identical in structure, except that the length of the finger is different and thus the length of the rubber member also varies. The lengths of the fingers of a man and a woman are also different and the fingers of persons of the same gender are different depending on the heights of the persons. As long as the above-mentioned finger motion aid is made into different models, the needs of various persons can be met.

In the finger motion aid, the control signal is received by the chip, so that the chip is bent and stretched. By placing the chip into the rubber member, the rubber member worn on the patient's finger drives the patient's finger to move as the chip moves, thus assisting the patient's fingers to exercise and gradually recover to health.

Second Embodiment

Figure 9:
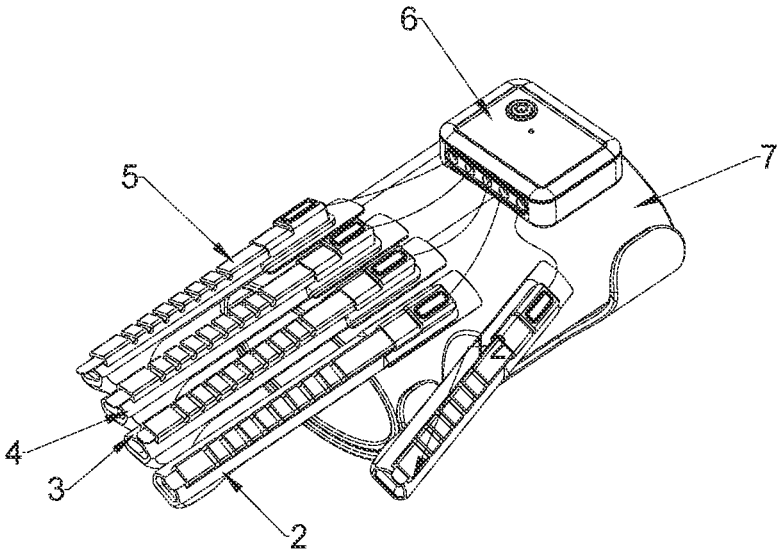
FIG. 9 shows a structural view of a rehabilitation hand having finger motion aids in a second embodiment.
Figure 10:
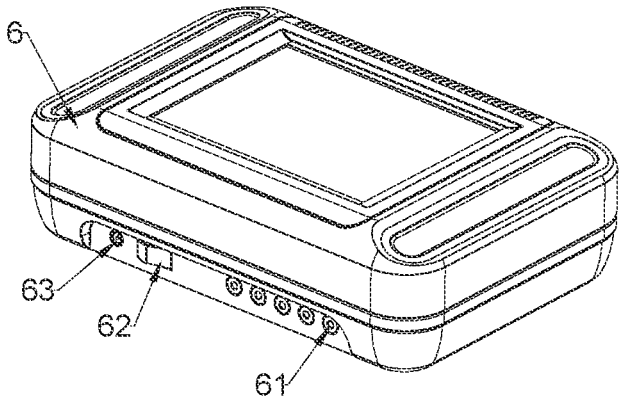
FIG. 10 shows a structural view of a controller in the second embodiment.

A rehabilitation hand having the finger motion aid as described above, as shown in FIG. 9, comprises at least one of a thumb motion aid 1, an index finger motion aid 2, a middle finger motion aid 3, a ring finger motion aid 4 and a little finger motion aid 5, and further comprises a controller 6 and a protective gear 7.

The finger motion aids according to the first embodiment can be worn on five fingers of a hand, which are respectively referred to as the thumb motion aid 1, the index finger motion aid 2, the middle finger motion aid 3, the ring finger motion aid 4 and the little finger motion aid 5. The finger motion aids worn on the fingers are different in length because of the different lengths of the five fingers, and the differences are mainly featured by the different numbers of the bridges 113 and the grooves 114. Except for that, there is no difference in the structure for the finger motion aids. The finger motion aids are respectively bonded to the protective gear 7 by means of the hook-and-loop fasteners, are convenient to disassemble and assemble, are easy to adjust, and are suitable for various deformed fingers.

The controller 6 is positioned at the back of the hand of the protective gear 7 to facilitate operation and fixed bonding to the protective gear 7. The controller 6 is provided with five identical electric wire sockets 61, and chips on the thumb motion aid 1, the index finger motion aid 2, the middle finger motion aid 3, the ring finger motion aid 4 and the little finger motion aid 5 are respectively connected to the five electric wire sockets 61 on the controller 6 via electric wires. The controller 6 is further provided with a power switch 62 for controlling power on and off of the controller 6. The controller 6 is further provided with a power socket 63 for connecting with an external power source to energize the controller 6. The controller 6 is used to receive an active assistance signal (a professional rehabilitation person wears a rehabilitation hand to actively perform bending and stretching actions), and synchronously transmit the signal to the chips on the five finger motion aids. Upon receipt of the synchronous signal by the chips on the five finger motion aids, the bending and stretching actions of the same intensity as performed by the professional rehabilitation person are synchronously performed to do rehabilitation training.

Figure 11:
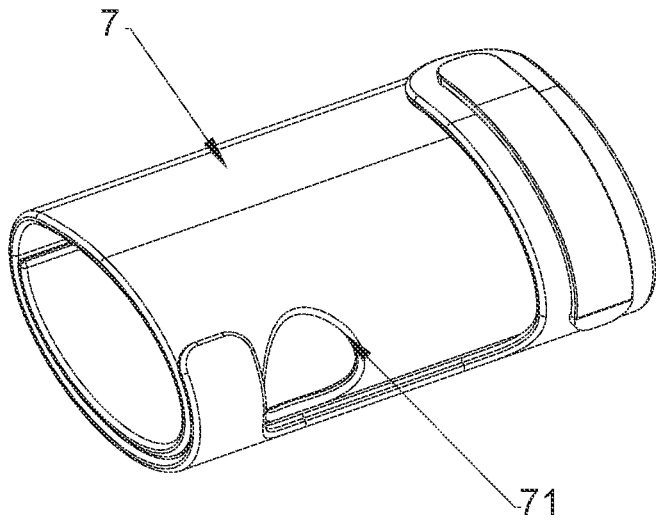
FIG. 11 shows a state diagram of a protective gear when folded in the second embodiment.
Figure 12:
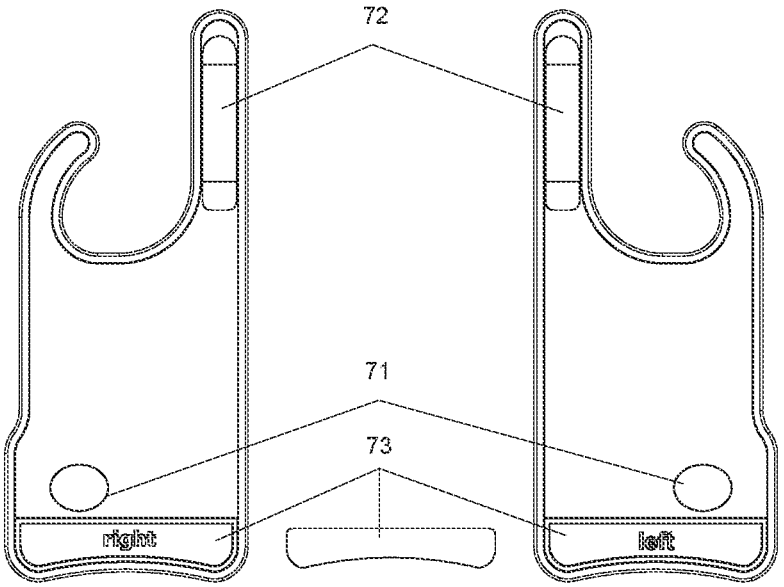
FIG. 12 shows a structural view showing the front side of the protective gear when unfolded in the second embodiment.
Figure 13:
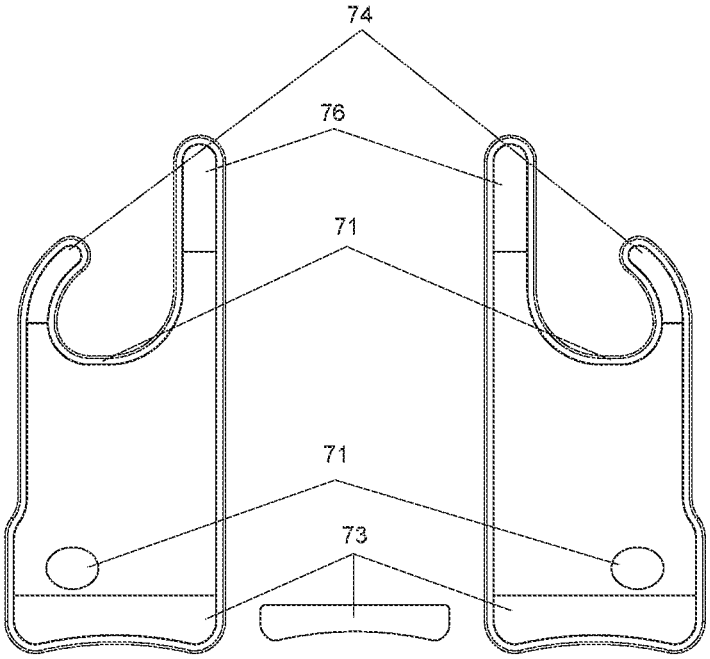
FIG. 13 shows a structural view showing the back side of the protective gear when unfolded in the second embodiment.

The protective gear 7, as shown in FIGS. 11 to 13, is worn on a palm and a wrist. FIG. 11 shows a state in which the protective gear is folded and the thumb is extended from a hole 71. FIGS. 12 and 13 respectively show two states of front and back sides of the protective gear 7 when it is unfolded. On the front side, there is a hook-and-loop fastener 72. The hook-and-loop fastener 72 is bonded to the surface of the protective gear when the protective gear is folded for binding and fixation. A hard sheet 73 is embedded in one end of the protective gear to facilitate operation when the protective gear is folded and bound to the palm and the wrist and to increase the binding tightness. The hard sheet may be a hard structure, such as a steel plate or an aluminum sheet. An end portion 74 has a certain degree of curvature and is disposed such that the hook-and-loop fastener on the end portion 74 is bonded to the protective gear at a position that is close to the thumb, so as not to affect bonding of the index finger motion aid 2 to the protective gear 7. The width of a position 75 is relatively large and thus the width of an end portion 76 is reduced, so as to facilitate bonding of the thumb motion aid 1 to the protective gear 7. The protective gear 7 is required to be breathable, dirt-resistant and lightweight, and is convenient for the patient to wear for a long time. In addition, the protective gear 7 is required to be elastic and flexible, and is convenient to wear. The surface of the protective gear 7 is to be bonded with the hook-and-loop fastener, so as to facilitate fixing the finger motion aids of the five fingers. The material of the protective gear 7 may be composite waterproof stretch flannelette, and other materials that accord with the property of the protective gear may be used.

When in use, the protective gear 7 is first worn on the palm and the wrist, then the controller 6 is fixed at the back of the hand of the protective gear 7, and then the five finger motion aids are respectively worn and bonded; and the five finger motion aids are connected to the controller through electric wires, and a power supply of the controller is turned on, so that finger motions can be performed synchronously with the professional rehabilitation person to assist rehabilitation of the patient.

The patient may wear a finger motion aid for a specific finger depending on a paralysis condition of the finger. If a certain finger is not paralyzed or deformed, it may not wear the finger motion aid, but a finger that is not able to be stretched may wear the finger motion aid.

The preferred embodiments of the present invention have been described above, and are merely illustrative and not restrictive to the present invention. It will be understood by those skilled in the art that many changes, modifications and even equivalents may be made within the spirit and scope of the present invention as defined by the appended claims, but would fall within the scope of protection of the present invention.

What is claimed is:

1. A rehabilitation hand device comprising:

a thumb motion aid, an index finger motion aid, a middle finger motion aid, a ring finger motion aid and a little finger motion aid, wherein each of the thumb motion aid, the index finger motion aid, the middle finger motion aid, the ring finger motion aid and the little finger motion aid comprise a finger motion aid;

the finger motion aid comprising:

a rubber member;

a plastic cover;

a finger sleeve, wherein the finger sleeve is provided at a front end of the rubber member, the finger sleeve has an open end, a finger is configured to extend through the open end, and the finger motion aid is configured to be worn on the finger by the finger sleeve; an elongated space, wherein the elongated space is formed by a first bridge, a last bridge, a plurality of intermediate bridges and a plurality of grooves, the elongated space is provided on a front face of the rubber member and a chip is placed in the elongated space; a width of the elongated space is greater than a width of the chip;

a back side of the rubber member has a curve radian, wherein the back side of the rubber member is configured to correspond to a curvature of the finger;

the plastic cover is disposed on the rubber member and fixedly connected to the rubber member, and a hook-and-loop fastener, wherein the hook-and-loop is disposed underneath the rubber member and fixedly connected to the rubber member, the rehabilitation hand device further comprising a controller and a protective gear, wherein the controller is disposed on the protective gear and fixedly connected to the protective gear;

the controller is electrically connected to the chip on the thumb motion aid, the chip on the index finger motion aid, the chip on the middle finger motion aid, the chip on the ring finger motion aid and the chip on the little finger motion aid, respectively; an active assistance signal is received by the controller and the active assistance signal synchronously transmitted to the chip on the thumb, the chip on index finger, middle finger, the chip on ring finger and the chip on little finger motion aids, so that the chip on the thumb, the chip on index finger, the chip on middle finger, the chip on ring finger and the chip on little finger motion aids are forced to synchronously perform a motion action;

the hook-and-loop fastener on the thumb motion aid, the hook-and-loop fastener on the index finger motion aid, the hook-and-loop fastener on the middle finger motion aid, the hook-and-loop fastener on the ring finger motion aid and the hook-and-loop fastener on the little finger motion aid are respectively bonded to the protective gear; and the protective gear is configured to be fixed on a wrist and a palm.

2. The rehabilitation hand according to claim 1, wherein the protective gear is embedded with a hard sheet at one end to facilitate wearing the protective gear on the wrist and the palm.

3. The rehabilitation hand according to claim 1, wherein a length of each of the first bridge and the last bridge is greater than a length of each of the plurality of intermediate bridges to prevent the chip from exiting from the first bridge and the last bridge.

4. The rehabilitation hand according to claim 1, wherein the finger sleeve has a segment of a flat surface at a position, wherein the finger sleeve is in contact with a finger pad for supporting the finger.

* * * * *